US008911217B2

(12) United States Patent
Takahashi

(10) Patent No.: US 8,911,217 B2
(45) Date of Patent: Dec. 16, 2014

(54) ABNORMALITY DETECTING DEVICE FOR HYDRAULIC SYSTEM

(75) Inventor: Katsuaki Takahashi, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 538 days.

(21) Appl. No.: 12/591,828

(22) Filed: Dec. 2, 2009

(65) Prior Publication Data

US 2010/0147256 A1 Jun. 17, 2010

(30) Foreign Application Priority Data

Dec. 12, 2008 (JP) ..... 2008-317392

(51) Int. Cl.
*F04B 49/08* (2006.01)
*F01M 1/20* (2006.01)

(52) U.S. Cl.
CPC ..... *F01M 1/20* (2013.01); *F04B 49/08* (2013.01); *F04B 2205/06* (2013.01)
USPC ..... 417/281; 417/44.2; 137/565.13

(58) Field of Classification Search
CPC ..... F04B 49/08; F04B 2205/06
USPC ..... 417/281; 340/451; 73/114.57; 137/565.13; 123/196 S
See application file for complete search history.

(56) References Cited

U.S. PATENT DOCUMENTS 3,723,964 A * 3/1973 Lace ..... 340/459
4,328,480 A * 5/1982 Keitel et al. ..... 340/451
4,489,305 A * 12/1984 Lang et al. ..... 340/459
4,489,311 A * 12/1984 Lang et al. ..... 340/501
4,504,819 A * 3/1985 Hosoya ..... 340/450.3
6,213,820 B1 * 4/2001 Kanno ..... 440/1
6,614,345 B2 * 9/2003 Kimata et al. ..... 340/450.3
7,665,352 B2 * 2/2010 Staley et al. ..... 73/114.57

FOREIGN PATENT DOCUMENTS

| | | |
|---|---|---|
| EP | 1 586 751 A2 | 10/2005 |
| JP | A-6-101439 | 4/1994 |
| JP | A-11-270323 | 10/1999 |
| JP | A-2000-328916 | 11/2000 |
| JP | A-2001-140619 | 5/2001 |
| JP | A-2002-147214 | 5/2002 |
| JP | A 2004-060612 | 2/2004 |
| JP | A-2005-188434 | 7/2005 |
| JP | A-2005-299616 | 10/2005 |
| JP | A 2008-286021 | 11/2008 |

* cited by examiner

*Primary Examiner* — Charles Freay
*Assistant Examiner* — Christopher Bobish
(74) *Attorney, Agent, or Firm* — Oliff PLC

(57) ABSTRACT

An abnormality detecting device for a hydraulic system is disclosed. The hydraulic system has a pressure level switching mechanism that adjusts oil pressure in accordance with the operating state of an internal combustion engine. The device includes an oil pressure sensor and a ECU. The oil pressure sensor detects an oil pressure that is adjusted by the pressure level switching mechanism. When the pressure level switching mechanism changes the oil pressure from a first oil pressure level to a second oil pressure level, which is higher than the first oil pressure level, the ECU compares the oil pressure detected by the oil pressure sensor with a determination oil pressure level, which is lower than and close to the second oil pressure level. The ECU determines that there is an abnormality in the hydraulic system if the oil pressure detected by the oil pressure sensor does not change to pass the determination oil pressure level.

16 Claims, 6 Drawing Sheets

ABNORMALITY DETECTING DEVICE FOR HYDRAULIC SYSTEM

FIELD OF THE INVENTION

The present invention relates to an abnormality detecting device for a hydraulic system having an oil pressure adjusting mechanism that adjusts oil pressure in accordance with the operating state of an internal combustion engine.

BACKGROUND OF THE INVENTION

There have been proposed devices for detecting pressure abnormalities in a hydraulic system having a mechanism that properly adjusts the pressure of engine oil in accordance with the operating state of an internal combustion engine.

Japanese Laid-Open Patent Publication No. 11-270323 discloses a device that detects abnormalities of a hydraulic system based on a comparison between the actual oil pressure and a lowest oil pressure that corresponds to the engine speed and the coolant temperature. This device determines that there is an abnormality when the actual oil pressure is lower than the lowest temperature, and outputs a warning signal.

Japanese Laid-Open Patent Publication No. 6-101439 discloses that an abnormality in a regulator valve for switching oil pressure is detected based on time for switching the regulator valve.

Japanese Laid-Open Patent Publication No. 2005-188434 discloses a device that detects abnormalities of a hydraulic system based on a comparison between the actual oil pressure and a lowest oil pressure that corresponds to the engine speed and the engine oil temperature. This device determines that there is an abnormality when the actual oil pressure is lower than the lowest temperature, and outputs a warning signal.

The devices disclosed in the above described Japanese Laid-Open Patent Publication Nos. 11-270323 and 2005-188434 cannot detect abnormalities in switching operations of oil pressure adjusting mechanisms such as regulator valves. Since the device disclosed in Japanese Laid-Open Patent Publication No. 6-101439 determines an abnormality directly based on the operating time of the regulator valve, the device is capable of detecting abnormalities in the operation of the regulator valve. However, this device cannot detect abnormalities in parts in the hydraulic system other than the regulator valve.

SUMMARY OF THE INVENTION

Accordingly, it is an objective of the present invention to reliably detect abnormalities in a hydraulic system having an oil pressure adjusting mechanism that adjusts oil pressure in accordance with the operating state of an internal combustion engine.

To achieve the foregoing objective and in accordance with a first aspect of the present invention, an abnormality detecting device for a hydraulic system is provided. The hydraulic system has an oil pressure adjusting mechanism that adjusts oil pressure in accordance with the operating state of an internal combustion engine. The device includes an oil pressure detecting section, an oil pressure comparing section, and an abnormality determining section. The oil pressure detecting section detects oil pressure adjusted by the oil pressure adjusting mechanism. When the oil pressure adjusting mechanism changes the oil pressure from a first oil pressure level to a second oil pressure level, which is higher than the first oil pressure level, the oil pressure comparing section compares the oil pressure detected by the oil pressure detecting section with a determination oil pressure level, which is lower than and close to the second oil pressure level. The abnormality determining section determines that there is an abnormality in the hydraulic system if the oil pressure detected by the oil pressure detecting section does not change to pass the determination oil pressure level.

In accordance with a second aspect of the present invention, an abnormality detecting device for a hydraulic system is provided. The hydraulic system has an oil pressure adjusting mechanism that adjusts oil pressure in accordance with the operating state of an internal combustion engine. The device includes an oil pressure detecting section, an oil pressure comparing section, and an abnormality determining section. The oil pressure detecting section detects oil pressure adjusted by the oil pressure adjusting mechanism. When the oil pressure adjusting mechanism changes the oil pressure from a first oil pressure level to a second oil pressure level, which is lower than the first oil pressure level, the oil pressure comparing section compares the oil pressure detected by the oil pressure detecting section with a determination oil pressure level, which is higher than and close to the second oil pressure level. The abnormality determining section determines that there is an abnormality in the hydraulic system if the oil pressure detected by the oil pressure detecting section does not change to pass the determination oil pressure level.

In accordance with a third aspect of the present invention, an abnormality detecting device for a hydraulic system is provided. The hydraulic system has an oil pressure adjusting mechanism that adjusts oil pressure in accordance with the operating state of an internal combustion engine. The device includes an oil pressure detecting section, an oil pressure comparing section, and an abnormality determining section. The oil pressure detecting section detects oil pressure adjusted by the oil pressure adjusting mechanism. When the oil pressure adjusting mechanism changes the oil pressure from a first oil pressure level to a second oil pressure level, which is set to be higher than the first oil pressure level, the oil pressure comparing section compares the oil pressure detected by the oil pressure detecting section with a determination oil pressure level, which is set to be lower than and close to the second oil pressure level. When the oil pressure adjusting mechanism changes the oil pressure from the first oil pressure level to the second oil pressure level, which is set to be lower than the first oil pressure level, the oil pressure comparing section compares the oil pressure detected by the oil pressure detecting section with the determination oil pressure level, which is set to be higher than and close to the second oil pressure level. The abnormality determining section determines that there is an abnormality in the hydraulic system if the oil pressure detected by the oil pressure detecting section does not change to pass the determination oil pressure level.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

A first embodiment of the present invention will now be described with reference to FIGS. 1 to 5B.

Figure 1:
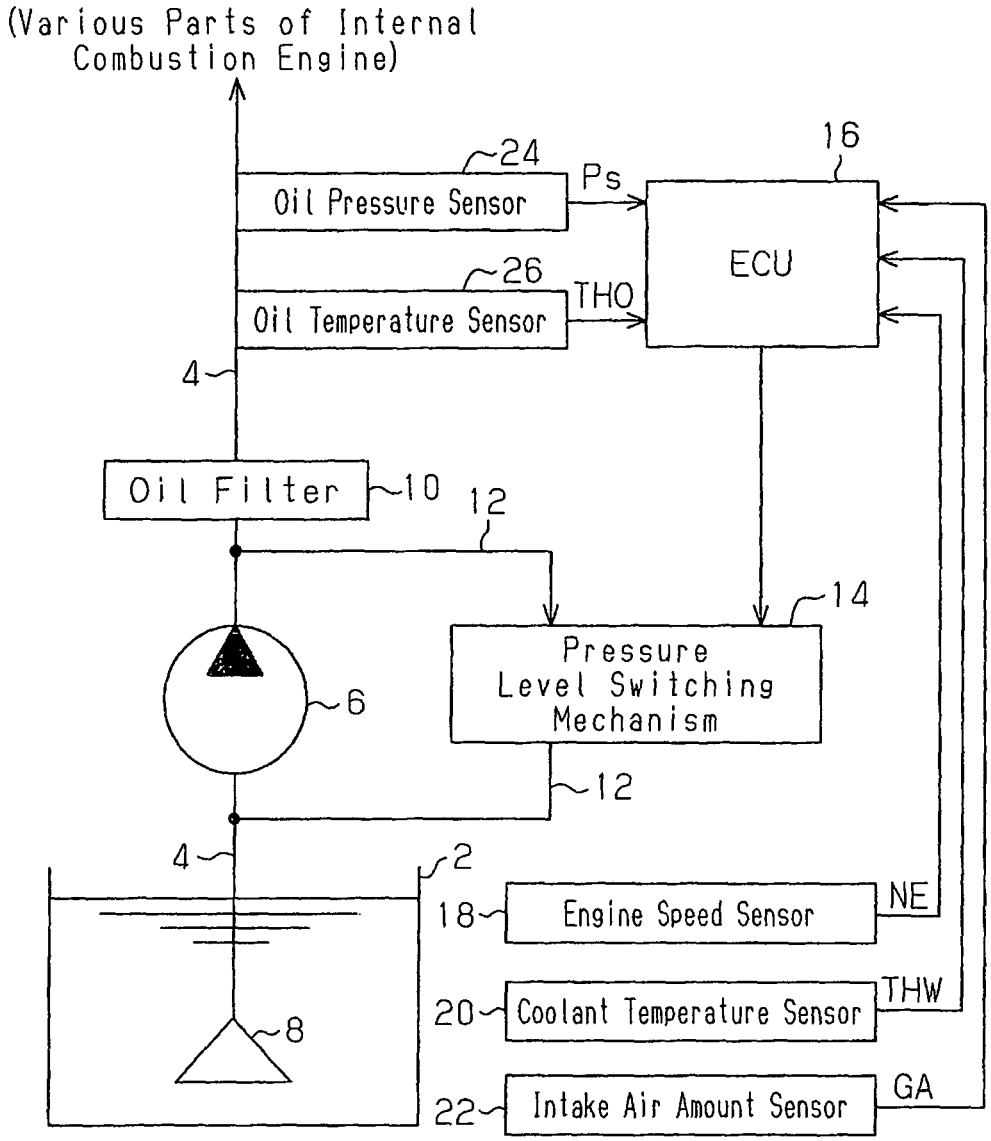
FIG. 1 is a block diagram schematically showing a hydraulic system according to a first embodiment of the present invention.

As shown in FIG. 1, a hydraulic system having an abnormality detecting device according to the present embodiment includes a main supply passage 4 that supplies engine oil stored in an oil pan 2 to various parts of an internal combustion engine of a vehicle. An oil pump 6 is located in the main supply passage 4. The oil pump 6 is driven by the engine to draw and discharge engine oil stored in the oil pan 2. An oil strainer 8 is attached to the upstream end of the main supply passage 4. Specifically, the oil strainer 8 is attached to an end of the main supply passage 4 located in the oil pan 2 to remove relatively large sized impurities in the engine oil. At a position downstream of the oil pump 6 in the main supply passage 4, an oil filter 10 for removing relatively small impurities in the engine oil is provided. When the oil pump 6 is driven as the engine operates, the oil pump 6 draws the engine oil in the oil pan 2 through the main supply passage 4. The engine oil is then supplied to various parts of the engine via the main supply passage 4. For example, the engine oil is supplied to hydraulically operated devices, a piston jet mechanism, and parts of the engine that need lubrication. The piston jet mechanism cools the pistons in the engine by spraying engine oil to the pistons.

Although a fixed displacement type oil pump is used as the oil pump 6, a variable displacement type may be used.

The main supply passage 4 includes a relief passage 12, which connects a section downstream of the oil pump 6 and a section upstream of the oil pump 6. Specifically, a first end of the relief passage 12 is connected to a section of the main supply passage 4 that is between the oil pump 6 and the oil filter 10, and a second end of the relief passage 12 is connected to a section of the main supply passage 4 that is between the oil pump 6 and the oil strainer 8. A pressure level switching mechanism 14 is provided in the relief passage 12. The pressure level switching mechanism 14 switches the pressure of engine oil supplied to parts of the engine between two stages, or a high pressure level and a low pressure level. The pressure level switching mechanism 14 is controlled by an electronic control unit (ECU) 16.

Further, an oil pressure sensor 24 and an oil temperature sensor 26 are provided in a section of the main supply passage 4 that is downstream of the joint of the first end of the relief passage 12 and the main supply passage 4. The oil pressure sensor 24 detects a pressure Ps of engine oil supplied to various parts of the engine, and the oil temperature sensor 26 detects a temperature THO of the engine oil.

The ECU 16 receives output signals of an engine speed sensor 18, which detects the engine speed NE, output signals of a coolant temperature sensor 20, which detects the temperature THW of coolant cooling the engine, and output signals of an intake air amount sensor 22, which detects an intake air amount GA. Further, the ECU 16 receives output signals of the oil pressure sensor 24 and output signals of the oil temperature sensor 26. Based on output signals of the sensors 18 to 26, the ECU 16 determines the operating state of the engine, and controls the engine accordingly. For example, the ECU 16 controls the pressure level switching mechanism 14.

Figure 2:
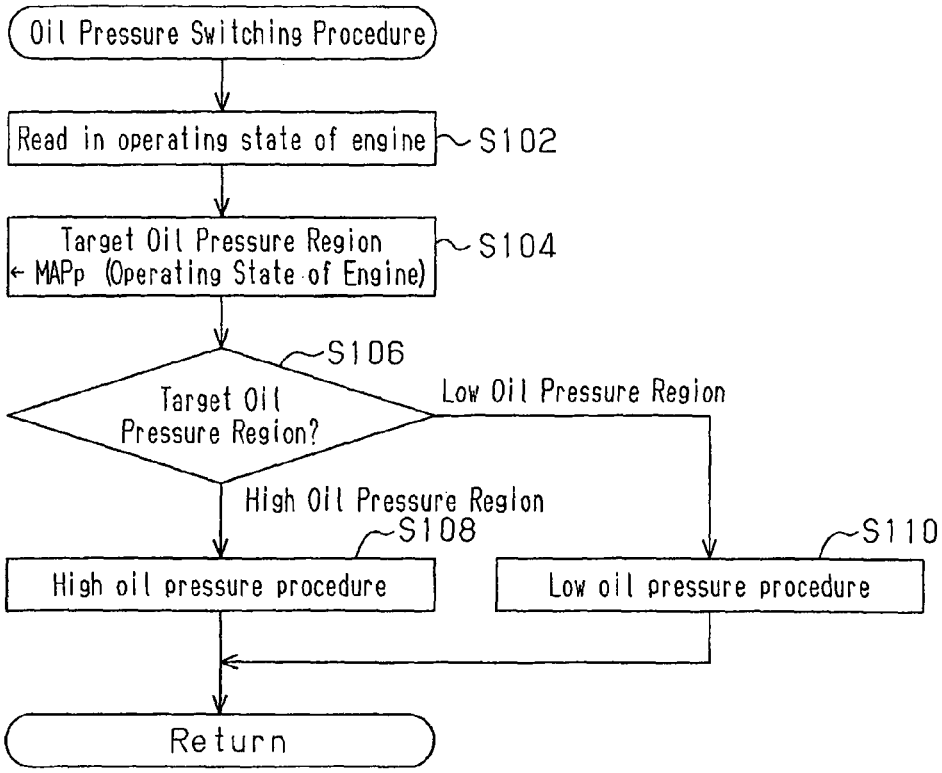
FIG. 2 is a flowchart showing a procedure for switching the pressure of engine oil executed by an ECU mounted in the hydraulic system shown in FIG. 1.

Specifically, the ECU 16 executes an oil pressure switching procedure shown in the flowchart of FIG. 2. Based on the operating state of the engine, the ECU 16 determines which of the high oil pressure region and the low oil pressure region should be set as a target oil pressure region of the engine oil by referring to a map MAPp shown in FIG. 3. The ECU 16 then controls the pressure level switching mechanism 14 so as to adjust the pressure of the engine oil to the selected one of the high pressure level and the low pressure level. The engine operating state is represented by the engine speed NE and the engine load (which is, in this case, the intake air amount GA). In addition to the engine speed NE and the engine load, the coolant temperature THW may be used as a parameter in the map MAPp.

The oil pressure switching procedure shown in FIG. 2 is periodically executed at a predetermined time interval or every time the crankshaft of the engine rotates by a predetermine angle.

Figure 3:
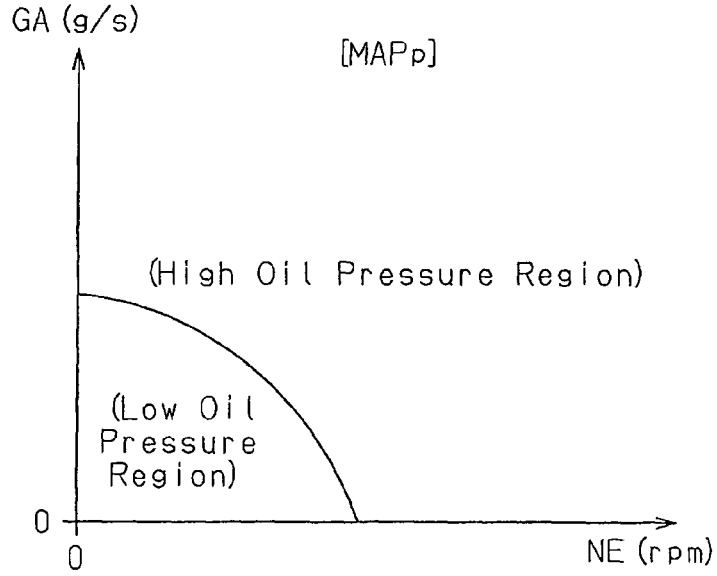
FIG. 3 is a graph for explaining the configuration of a map for setting a target oil pressure region according to the first embodiment.

In the oil pressure switching procedure, the current engine operating state, which includes the engine speed NE and the intake air amount GA, is read in (S102). Next, based on the engine operating state, one of the high oil pressure region and the low oil pressure region in the map MAPp shown in FIG. 3 is selected as a target oil pressure region of the engine oil (S104).

Subsequently, the target oil pressure region set in step S104 is judged (S106). When the target oil pressure region is set to the high oil pressure region, the ECU 16 causes the pressure level switching mechanism 14 to execute a high oil pressure level procedure for switching the pressure level of the engine oil to the high oil pressure level, so as to increase the pressure of the engine oil supplied to the various parts of the engine through the main supply passage 4 (S108). When the target oil pressure region is set to the low oil pressure region, the ECU 16 causes the pressure level switching mechanism 14 to execute a low oil pressure level procedure for switching the pressure level of the engine oil to the low oil pressure level, so as to decrease the pressure of the engine oil supplied to the various parts of the engine through the main supply passage 4 (S110).

Thereafter, the above described procedure is repeated at a predetermined cycle. Through this procedure, the target oil pressure region is set to the low oil pressure region when the engine is operating at a low engine speed and low load. In other operating states, the target oil pressure region is set to the high oil pressure region. In the low oil pressure region, the pressure of the engine oil is decreased so that excessive amount of engine oil is not supplied to the various parts of the engine. Thus, unnecessary energy consumption is prevented. In the high oil pressure region, the engine oil is allowed to reach all the necessary parts in the engine so that wear of the parts is suppressed and that the hydraulically operated devices and the piston jet mechanism are reliably operated.

Figure 4:
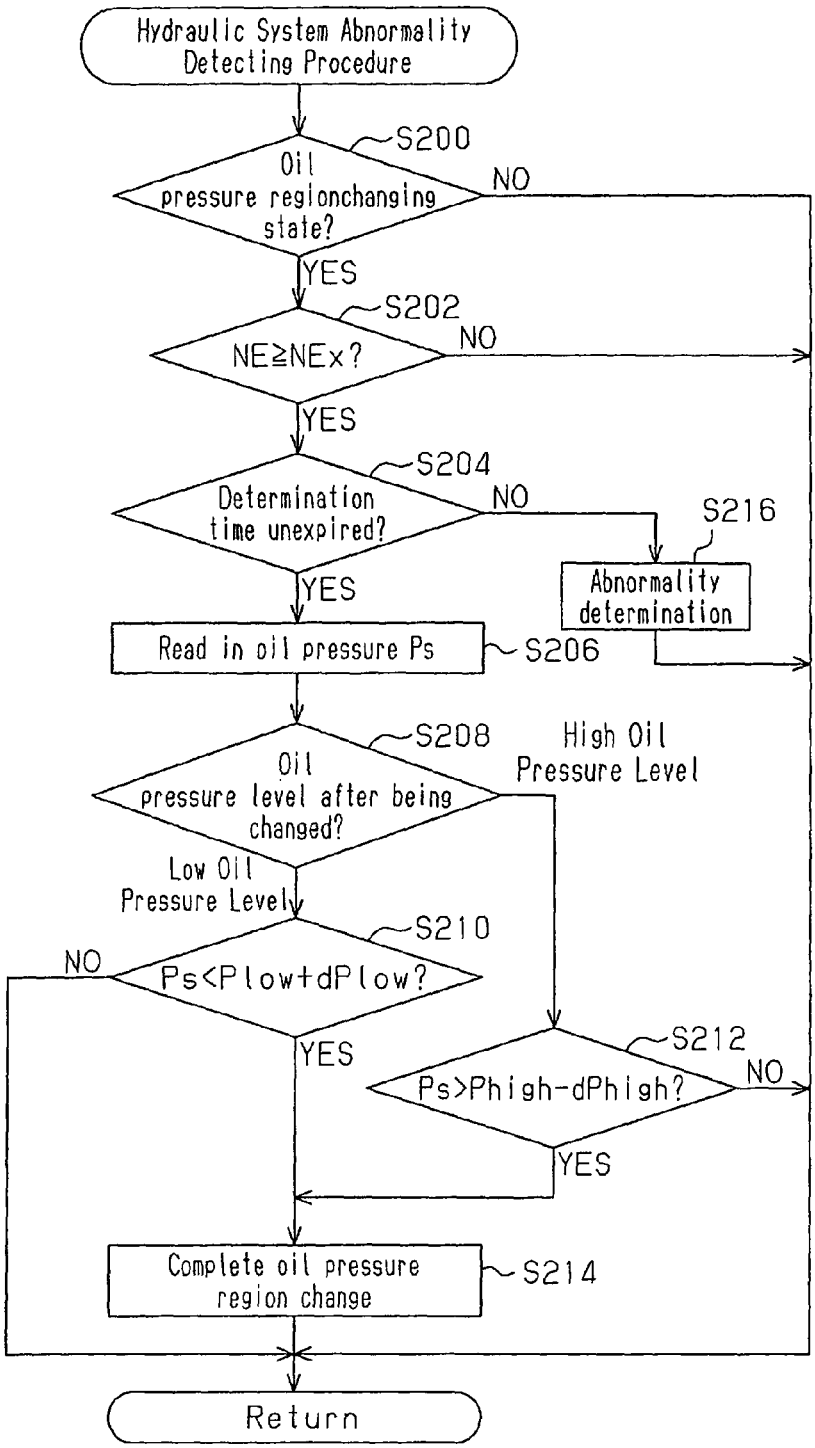
FIG. 4 is a flowchart showing a procedure for detecting abnormalities in the hydraulic system executed by the ECU mounted in the hydraulic system shown in FIG. 1.

Also, the ECU 16 executes a hydraulic system abnormality detecting procedure shown in the flowchart of FIG. 4. The abnormality detecting procedure is periodically executed at a predetermined time interval.

When the abnormality detecting procedure shown in FIG. 4 is started, it is first determined whether the hydraulic system is in an oil pressure region changing state (S200). The oil pressure region changing state refers to a state of the hydraulic system immediately after the target oil pressure region has been changed from the high oil pressure region to the low oil pressure region, or from the low oil pressure region to the high oil pressure region. That is, the oil pressure region changing state refers to a state in which the oil pressure has not reached a newly set target oil pressure region.

If the target oil pressure region has been changed to the low oil pressure region or to the high oil pressure region, and the actual oil pressure is in the corresponding target oil pressure region, the hydraulic system is not in the oil pressure region changing state (NO at S200). The procedure is therefore temporarily suspended. Thereafter, as long as the target oil pressure region is not switched, negative determination is made at step S200 at a predetermined time interval. In this case, the subsequent processes related to the abnormality detection are not executed.

When the target oil pressure region set in step S104 of the oil pressure switching procedure shown in FIG. 2 is changed, the pressure level switching mechanism 14 switches the operation from the high oil pressure process (S108) to the low oil pressure process (S110), or from the low oil pressure level procedure (S110) to the high oil pressure level procedure (S108). Then, the hydraulic system is in the oil pressure region changing state (YES at S200), and it is determined whether the engine speed NE is greater than or equal to a threshold engine speed NEx (S202).

As shown in FIG. 5, the lower the engine speed NE, the smaller the difference between the oil pressure adjusted to the high oil pressure level and the oil pressure adjusted to the low oil pressure level becomes. Therefore, when the engine speed NE is in a low speed region, the hydraulic system may be determined to be malfunctioning even if the hydraulic system is functioning normally. The threshold engine speed NEx is the lowermost value of a region of the engine speed NE that is set to avoid such erroneous determinations. Further, taking into consideration the tolerance of oil pressure adjustment by the pressure level switching mechanism 14 and the tolerance of detection by the oil pressure sensor 24, the threshold engine speed NEx is set to a relatively high engine speed NE so that an abnormality of change in the oil pressure clearly detected when the pressure level switching mechanism 14 switches the pressure level between the high oil pressure level and the low oil pressure level. The threshold engine speed NEx may be determined by taking into consideration not only the engine speed NE, but also the temperature THO of engine oil.

If the engine speed NE is lower than the threshold engine speed NEx (NO at S202), the current procedure is terminated.

If the engine speed NE is greater than or equal to the threshold engine speed NEx (YES at step S202), it is then determined whether determination time is unexpired (S204). The determination time is set as a period from when the target oil pressure region is switched to when the oil pressure actually reaches the target oil pressure region in a case where the hydraulic system is functioning normally. The determination time may be a fixed value, but may be changed based on the operating state of the engine, for example, the engine speed NE, the engine oil temperature THO, and the coolant temperature THW.

At an early stage of the oil pressure region changing state of the hydraulic system, the determination time is unexpired (YES at S204), the oil pressure Ps detected by the oil pressure sensor 24 is read in (S206).

Then, it is determined whether the oil pressure level after the oil pressure region is changed is the low oil pressure level or the high oil pressure level based on the data of the target oil pressure region set at step S104 of the oil pressure switching procedure shown in FIG. 2 (S208).

If the oil pressure level after the oil pressure region is changed is determined to be the low oil pressure level at step S208, the oil pressure Ps is evaluated using expression (1) at step S210.

$$Ps<P\text{low}+dP\text{low} \quad (1)$$

Signs Plow and dPlow represent the oil pressure of the low oil pressure level and an offset value of the low oil pressure level, respectively. The oil pressure Plow of the low oil pressure level corresponds to an oil pressure generated at the current engine speed NE when the pressure level switching mechanism 14 sets the oil pressure level to the low oil pressure level. The value of the oil pressure Plow of the low oil pressure level is computed by referring to a map in which the engine speed NE is used as a parameter as shown by a solid line in the graph of FIG. 5A. The map may use the engine oil temperature THO as another parameter.

Figure 5A:
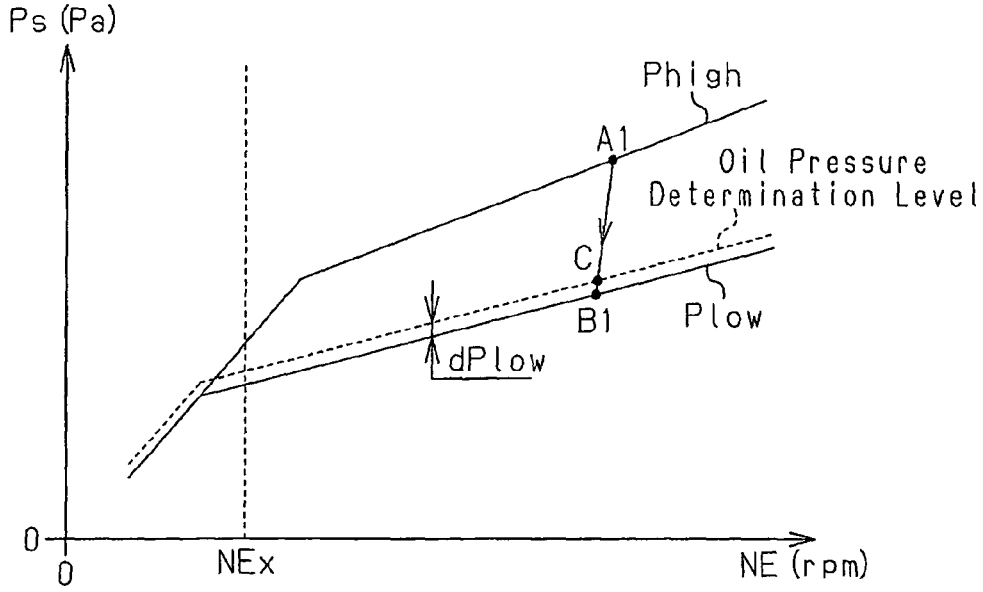
FIGS. 5A and 5B are graphs for explaining the abnormality detecting procedure according to the first embodiment.

The offset value dPlow of the low oil pressure level is a value for setting an oil pressure level that is higher than and close to the low oil pressure level Plow, that is, a determination oil pressure level C, as shown by a broken line in the graph of FIG. 5A. The offset value dPlow of the low oil pressure level is, for example, slightly greater than the tolerance of oil pressure adjustment when the mechanism 14 adjusts the oil pressure to the low oil pressure level. The resultant of the addition of the offset value dPlow to the oil pressure Plow of the low oil pressure level is the determination oil pressure level C.

That is, the expression (1) is used for evaluating whether the oil pressure Ps has passed the determination oil pressure level C close to an oil pressure B1 while being lowered from an oil pressure A1 of the high oil pressure level to the oil pressure B1 of the low oil pressure level due to the switching of the oil pressure level from the high oil pressure level to the low oil pressure level as shown by an arrow in the graph of FIG. 5A.

The expression (1) does not hold true at an early stage of the pressure level switching (NO at S210), the procedure is temporarily suspended.

If the hydraulic system including the pressure level switching mechanism 14 is functioning normally, the expression (1) holds true within the determination time (YES at S210). That is, in FIG. 5A, it is determined that the oil pressure has dropped to the oil pressure B1 from the oil pressure A1 via the determination oil pressure level C.

Accordingly, it is determined that change of the oil pressure region has been completed (S214). In the subsequent control cycle, this procedure will be immediately terminated since the hydraulic system will not be in the oil pressure region changing state (NO at S200). Thereafter, the oil level switching mechanism 14 adjusts the pressure of the engine oil at the low oil pressure level.

If the target oil pressure region is determined to be the high oil pressure level at step S208, the oil pressure Ps is evaluated using expression (2) at step S212.

$$Ps>P\text{high}-dP\text{high} \quad (2)$$

Signs Phigh and dPhigh represent the oil pressure of the high oil pressure level and an offset value of the high oil pressure level, respectively. The oil pressure Phigh of the high oil pressure level corresponds to an oil pressure generated at the current engine speed NE when the pressure level switching mechanism 14 sets the oil pressure level to the high oil pressure level. The value of the oil pressure Phigh of the high oil pressure level is computed by referring to a map in which the engine speed NE is used as a parameter as shown by a solid line in the graph of FIG. 5B. The map may use the engine oil temperature THO as another parameter.

Figure 5B:
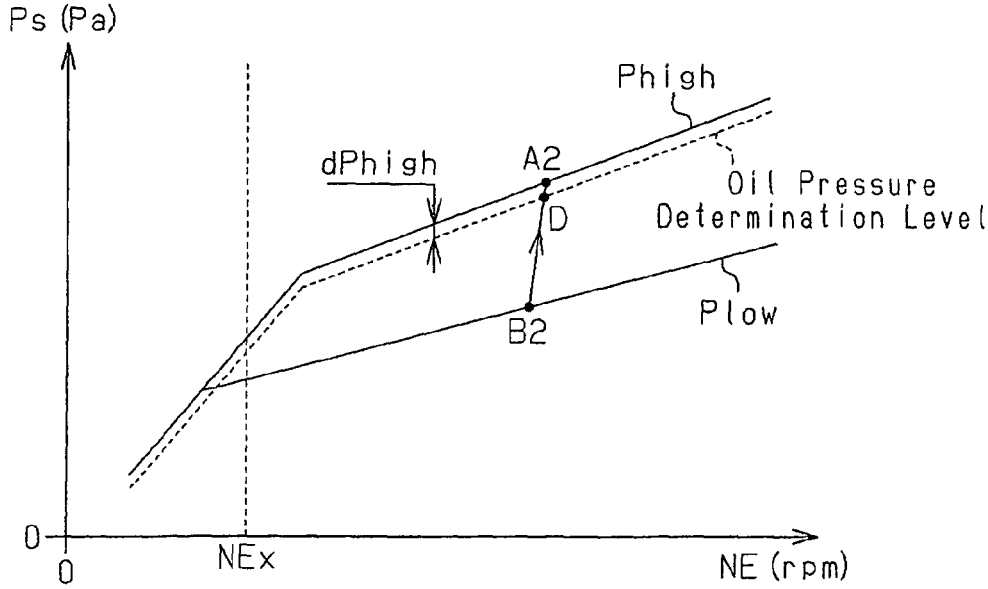

The offset value dPhigh of the high oil pressure level is a value for setting an oil pressure level that is lower than and close to the high oil pressure level Phigh, that is, a determination oil pressure level D, as shown by a broken line in the graph of FIG. 5B. The offset value dPhigh of the high oil pressure level is, for example, slightly greater than the tolerance of oil pressure adjustment when the mechanism 14 adjusts the oil pressure to the high oil pressure level. The resultant of the subtraction of the offset value dPhigh from the oil pressure Phigh of the high oil pressure level is the determination oil pressure level D.

That is, the expression (2) is used for evaluating whether the oil pressure Ps has passed the determination oil pressure level D close to an oil pressure A2 while being raised from an oil pressure B2 of the low oil pressure level to the oil pressure A2 of the high oil pressure level due to the switching of the oil pressure level from the low oil pressure level to the high oil pressure level as shown by an arrow in the graph of FIG. 5B.

The expression (2) does not hold true at an early stage of the pressure level switching (NO at S212), the procedure is temporarily suspended.

If the hydraulic system including the pressure level switching mechanism 14 is functioning normally, the expression (2) holds true within the determination time (YES at S212). That is, in FIG. 5B, it is determined that the oil pressure has reached the oil pressure A2 from the oil pressure B2 via the determination oil pressure level D.

Accordingly, it is determined that change of the oil pressure region has been completed (S214). In the subsequent control cycle, this procedure will be immediately terminated since the hydraulic system will not be in the oil pressure region changing state (NO at S200). Thereafter, the oil level switching mechanism 14 adjusts the pressure of the engine oil at the high oil pressure level.

If there is an abnormality in the hydraulic system including the pressure level switching mechanism 14, and the oil pressure cannot be changed, the expression (1) or the expression (2) may not hold true within the determination time. In this case, the determination time elapses (NO at S204), and an abnormality determination is made (S216). When such an abnormality determination is made, a warning lamp provided in the vehicle is lit to notify the driver of the abnormality, and the engine operation is switched to a fail-safe mode. When the target oil pressure region cannot be switched from the high oil pressure region to the low oil pressure region, the output power of the engine is not limited. In contrast, when the target oil pressure region cannot be switched from the low oil pressure region to the high oil pressure region, the output power of the engine is limited, so that ht engine is protected.

In the above described configuration, the pressure level switching mechanism 14 corresponds to an oil pressure adjusting mechanism, the oil pressure sensor 24 corresponds to an oil pressure detecting section, the engine speed sensor 18 corresponds to an engine speed detecting section, and the ECU 16 corresponds to an oil pressure comparing section and an abnormality determining section. Also, steps S200, and S206 to S212 of the hydraulic system abnormality detection procedure of FIG. 4 correspond to a procedure executed by the oil pressure comparing section, and steps S202, S204, S216 correspond to a procedure executed by the abnormality determining section.

The first embodiment has the following advantages.

(1) As shown in FIG. 5A, when the pressure level switching mechanism 14 changes the oil pressure A1, which corresponds to the first oil pressure level, to the oil pressure B1, which corresponds to the second oil pressure level lower than the oil pressure A1, the actual oil pressure Ps detected by the oil pressure sensor 24 should move from the oil pressure A1 to the oil pressure B1 via the determination oil pressure level C, which is shown by a broken line, if the oil pressure is controlled normally. Therefore, if the oil pressure does not pass the determination oil pressure level C (NO at S204), it is determined that there is an abnormality in the hydraulic system including the pressure level switching mechanism 14.

Likewise, as shown in FIG. 5B, when the pressure level switching mechanism 14 changes the oil pressure B2, which corresponds to the first oil pressure level (oil pressure level before being changed), to the oil pressure A2, which corresponds to the second oil pressure level (oil pressure level after being changed) higher than the oil pressure B2, the actual oil pressure Ps detected by the oil pressure sensor 24 should move from the oil pressure B2 to the oil pressure A2 via the determination oil pressure level D, which is shown by a broken line, if the oil pressure is controlled normally. Therefore, if the oil pressure does not pass the determination oil pressure level D (NO at S204), it is determined that there is an abnormality in the hydraulic system including the pressure level switching mechanism 14.

Particularly, since the determination oil pressure levels are set to be close to the oil pressure Plow of the low oil pressure level and the oil pressure Phigh of the high oil pressure level, respectively, a minor abnormality in the hydraulic system can be reliably detected.

(2) The determination oil pressure level (Plow+dPlow) is close to the oil pressure Plow of the low oil pressure level. The offset value dPlow of the low oil pressure level, which is the difference between the determination oil pressure level (Plow+dPlow) and the oil pressure Plow of the low oil pressure level, has a constant value regardless of the engine speed NE. Likewise, the determination oil pressure level (Phigh−dPhigh) is close to the oil pressure Phigh of the high oil pressure level. The offset value dPhigh of the high oil pressure level, which is the difference between the determination oil pressure level (Phigh−dPhigh) and the oil pressure Phigh of the high oil pressure level, has a constant value regardless of the engine speed NE. Since the determination oil pressure levels can be easily calculated by subjecting the oil pressure Plow of the low oil pressure level and the oil pressure Phigh of the high pressure level to simple addition or subtraction, the comparison of oil pressures (S210, S212) and the accompanying determination of an abnormality can be readily performed.

(3) Since the oil pump 6 is driven by the engine to generate oil pressure, the difference between the oil pressure Plow of the low oil pressure level and the oil pressure Phigh of the high oil pressure level is small in a region of low engine speed NE as shown in FIGS. 5A and 5B. Therefore, in some cases, depending on the settings, the determination oil pressure levels are equal to or greater than the first oil pressure level, which is the oil pressure level before being changed. In such cases, the abnormality determination will be inaccurate. However, according to the present embodiment, the hydraulic system abnormality detection procedure is not executed if the engine speed NE is lower than the threshold engine speed NEx (NO at S202). The threshold engine speed NEx is set to a sufficiently high value so that the abnormality detection is not influenced by the tolerance of the oil pressure adjustment by the pressure level switching mechanism 14 and the tolerance of detection by the oil pressure sensor 24.

Accordingly, the abnormality detection is reliably performed.

(4) The determination oil pressure levels (Plow+dPlow, Phigh−dPhigh) are set to be close to the second oil pressure levels (Plow, Phigh), which are oil pressure levels after being changed. Therefore, the engine speed region in which the determination oil pressure levels (Plow+dPlow, Phigh−dPhigh) become equal to or surpass the first oil pressure levels (Phigh, Plow), which are oil pressure levels before being changed are prevented from being expanded toward the higher engine speeds. Accordingly, the engine speed region in which the existence of an abnormality can be detected is prevented from being narrowed. This increases the frequency of the determination.

Figure 6A:
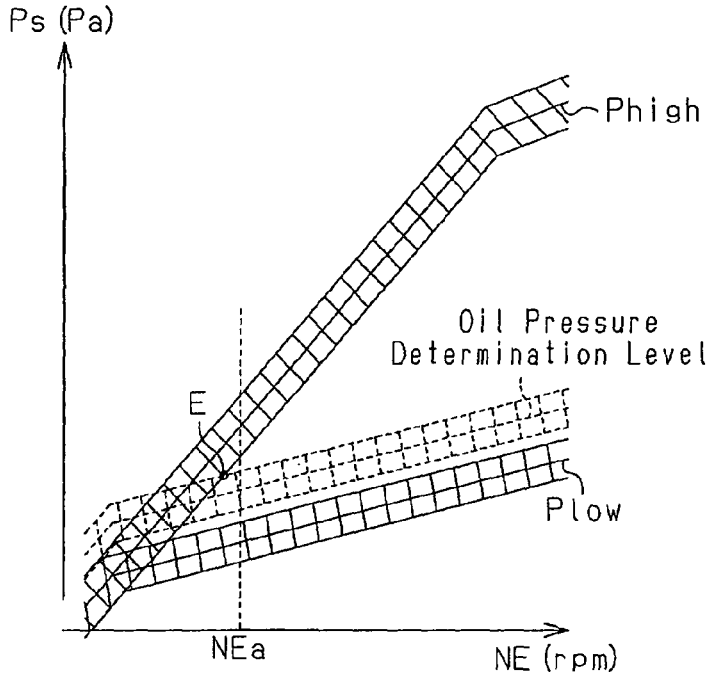
FIGS. 6A and 6B are enlarged graphs for explaining threshold engine speeds according to a second embodiment of the present invention.
Figure 6B:
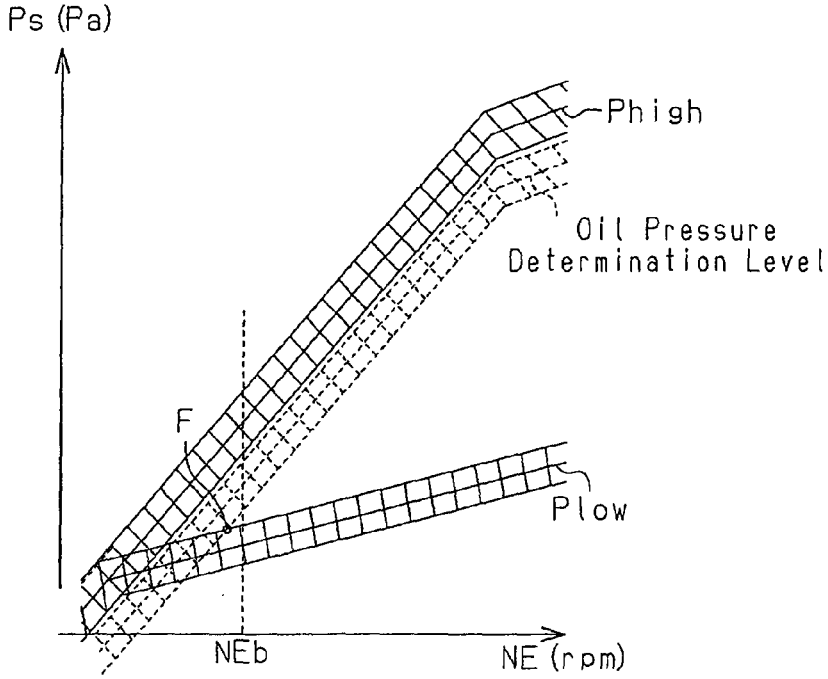

A second embodiment of this invention will now be described referring to FIGS. 6A to 7. In the first embodiment, the threshold engine speed NEx is set such that the difference between the oil pressure Phigh of the high oil pressure level and the oil pressure Plow of the low oil pressure level is sufficiently great, so that the abnormality detection is not influenced by the tolerance of oil pressure adjustment by the pressure level switching mechanism 14 and the tolerance of detection by the oil pressure sensor 24. In contrast, the second embodiment is different from the first embodiment in that, instead of the threshold engine speed NEx, a first threshold engine speed NEa and a second threshold engine speed NEb are set as shown in FIGS. 6A and 6B. The first threshold engine speed NEa is a threshold engine speed of the low oil pressure level, and the second threshold engine speed NEb is a threshold engine speed of the high oil pressure level.

Figure 7:
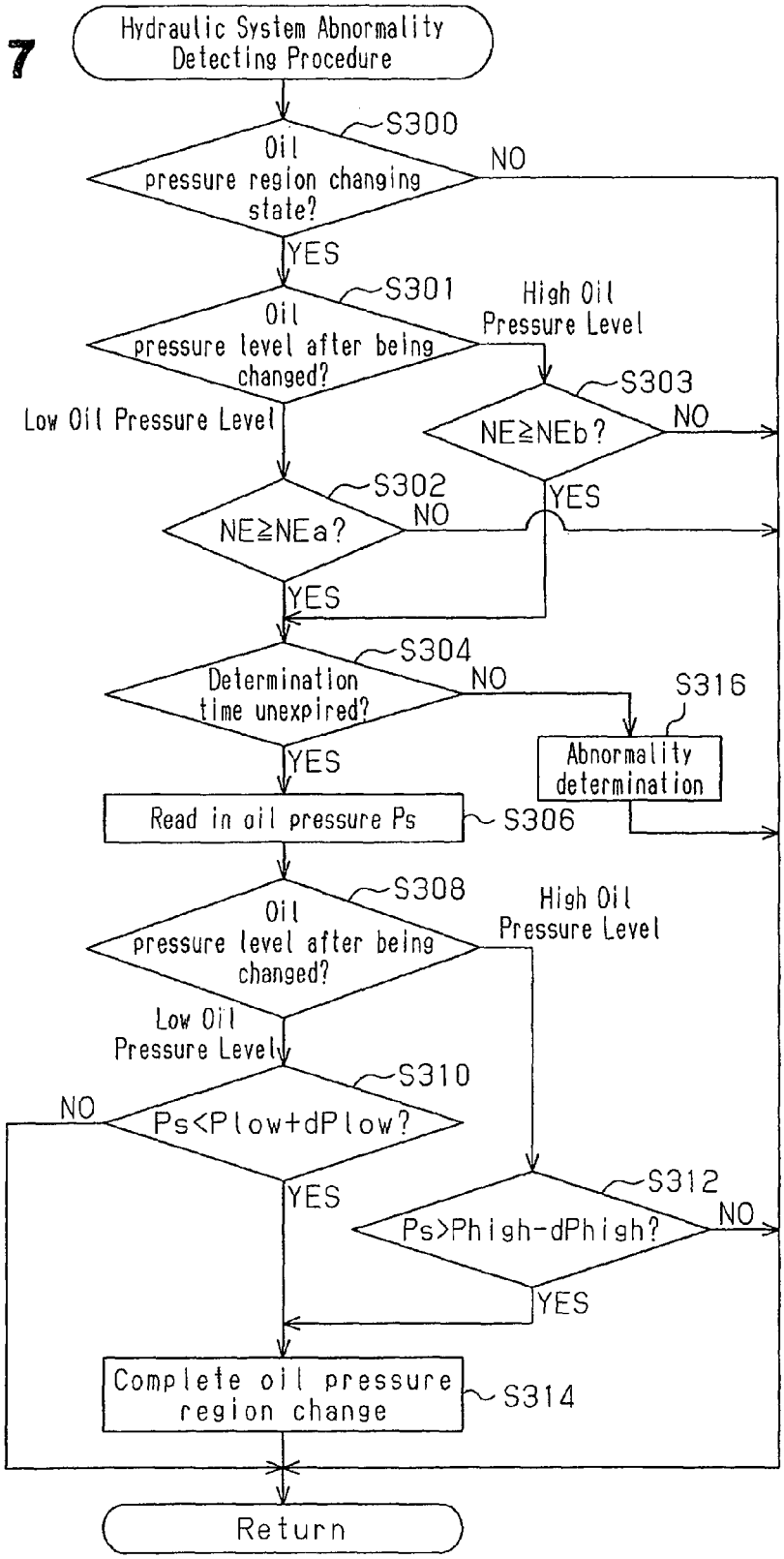
FIG. 7 is a flowchart showing a procedure for detecting abnormalities in the hydraulic system executed by the ECU according to the second embodiment.

Accordingly, in the second embodiment, a hydraulic system abnormality detecting procedure shown in FIG. 7 is executed instead of the procedure of the first embodiment shown in FIG. 4. The remainder of the configuration is the same as those of the first embodiment.

As shown in FIG. 7, in the hydraulic system abnormality detecting procedure, steps S300, S304 to S316 are the same as steps S200, S204 to S216 described in the first embodiment shown in FIG. 4. The present embodiment is different from the first embodiment in that steps S301 to S303 shown in FIG. 7 are performed instead of step S202 shown in FIG. 4.

That is, when the hydraulic system is in the oil pressure region changing state (YES at S300), it is determined whether the oil pressure level after oil pressure region is changed is the low oil pressure level or the high oil pressure level based on the data of the target oil pressure region set at step S104 of the oil pressure switching procedure shown in FIG. 2 (S301).

If the pressure level after being changed is the low oil pressure level, it is determined whether the engine speed NE is greater than or equal to the first threshold engine speed NEa (S302). The first threshold engine speed NEa is set as shown in FIG. 6A. If the pressure level after being changed is the high oil pressure level, it is determined whether the engine speed NE is greater than or equal to the second threshold engine speed NEb (S303). The second threshold engine speed NEb is set as shown in FIG. 6B.

That is, as described above, the lower the engine speed NE, the smaller the difference between the oil pressure adjusted to the high oil pressure level and the oil pressure adjusted to the low oil pressure level becomes. Also, as the engine speed NE decreases, the influence of the tolerance of oil pressure adjustment by the pressure level switching mechanism 14 and the tolerance of detection by the oil pressure sensor 24 becomes greater. The threshold engine speed NEx is thus set to a relatively high engine speed NE so that an abnormality of change in the oil pressure is clearly detected.

On the other hand, in the present embodiment, the threshold engine speeds NEa, NEb are used instead of the threshold engine speed NEx. Different one of the threshold engine speed NEa, NEb is used for each of the case where the oil pressure level is switched to the low oil pressure level (FIG. 6A) and the case where the oil pressure level is switched to the high oil pressure level (FIG. 6B). The threshold engine speeds NEa, NEb are set such that the range of the engine speed NE in which abnormality determination of the hydraulic system can be performed is expanded to the lower speed side.

That is, when the changed pressure level is the low oil pressure level, as shown in FIG. 6A, the tolerance of detection of the oil pressure determination level by the oil pressure sensor 24 corresponds to the width of the hatched area shown by broken lines. The tolerance of oil pressure adjustment of the oil pressure Phigh of the high oil pressure immediately before being changed corresponds to the width of the hatched area shown by solid lines in FIG. 6A.

There is a possibility that change in the oil pressure cannot be clearly detected in the overlapping section of these hatched areas. Therefore, in a case where the engine speed NE is lower than the intersection E of the lower side of the solid line-hatched area and the upper side of the dotted line-hatched area, even if there is an abnormality in the hydraulic system, erroneous detection may occur as to whether the oil pressure has passed the determination oil pressure level after the pressure level switching mechanism 14 switches the pressure level to the low oil pressure level. Therefore, the first threshold engine speed NEa is set to a value that is greater than and maximally close to the engine speed corresponding to the intersection E.

On the other hand, when the pressure level after the oil pressure region is changed is the low oil pressure level, as shown in FIG. 6B, the tolerance of detection of the oil pressure determination level by the oil pressure sensor 24 corresponds to the width of area shown by broken lines. The tolerance of oil pressure adjustment of the oil pressure Plow of the low oil pressure immediately before being changed corresponds to the width of the hatched area shown by solid lines in FIG. 6B.

There is a possibility that change in the oil pressure cannot be clearly detected in the overlapping section of these hatched areas. Therefore, in a case where the engine speed NE is lower than the intersection F of the upper side of the solid line-hatched area and the lower side of the dotted line-hatched area, even if there is an abnormality in the hydraulic system, erroneous detection may occur as to whether the oil pressure has passed the determination oil pressure level after the pressure level switching mechanism 14 switches the pressure level to the high oil pressure level. Therefore, the second threshold engine speed NEb is set to a value that is greater than and maximally close to the engine speed corresponding to the intersection F.

The threshold engine speeds NEa, NEb may be determined by taking into consideration not only the engine speed NE, but also the temperature THO of engine oil.

If the engine speed NE is determined to be lower than the first threshold engine speed NEa at step S302 or if the engine speed NE is determined to be lower than the second threshold engine speed NEb at step S303 (NO at S302 or NO at S303), the current procedure is terminated.

If the engine speed NE is determined to be higher than or equal to the first threshold engine speed NEa at step S302 or if the engine speed NE is determined to be higher than or equal to the second threshold engine speed NEb at step S303 (YES at S302 or YES at S303), it is then determined whether the determination time is unexpired. The procedure subsequent to step S304 (S304 to S316) is the same as that of steps S204 to S216 shown in FIG. 4, which is described above.

In the above described configuration, steps S300, and S306 to S312 of the hydraulic system abnormality detection procedure (FIG. 7) correspond to a procedure executed by the oil pressure comparing section, and steps S301 to S304, and S316 correspond to a procedure executed by the abnormality determining section.

In addition to the advantages of the first embodiment, the second embodiment has the following advantages.

(5) The threshold engine speeds NEa, NEb are each set to be maximally close to the upper limit (intersections E, F) of a range of the engine speed NE in which the tolerance of the oil pressure adjustment by the pressure level switching mechanism 14 and the tolerance of detection by the oil pressure sensor 24 overlap. Thus, the abnormality determination is reliably executed taking into consideration the tolerances, and the range of engine speed in which the abnormality determination can be performed is expanded. This allows the abnormality determination to be highly accurate, so that an abnormality in the hydraulic system is reliably detected.

Since the determination oil pressure level is set to be closed to the low oil pressure level, which is the second oil pressure level after being changed, or the oil pressure Phigh of the high oil pressure level, the intersections E, F are at maximally low engine speed region. Accordingly, the engine speed range in which the abnormality determination can be executed is maximally expanded, which enhances the advantage of item (4) of the first embodiment.

The above embodiments may be modified as follows.

In the first and second embodiments, the abnormality determination is executed both in the case where the target oil pressure region is switched from the high oil pressure region to the low oil pressure region, and from the low oil pressure region to the high oil pressure region, using the corresponding determination oil pressure level (Plow+dPlow, Phiigh−dPhigh). However, the abnormality determination may be executed in only one of these cases.

That is, the abnormality determination may be executed at the determination oil pressure level (Plow+dPlow) only when the target oil pressure region is switched from the high oil pressure region to the low oil pressure region. Alternatively, the abnormality determination may be executed at the determination oil pressure level (Phigh−dPhigh) only when the target oil pressure region is switched from the low oil pressure region to the high oil pressure region.

In the first and second embodiments, the pressure of engine oil supplied to various parts of the engine is switched between two stages, or the high pressure level and the low pressure level, by the pressure level switching mechanism 14 in accordance with the operation state of the engine. The number of stages of the oil pressure levels may be three or more.

Alternatively, a pressure level switching mechanism that performs continuous control may be provided, so as to continuously adjust the oil pressure in accordance with the operating state of the engine.

In either case, when the oil pressure is switched between two oil pressure regions, an abnormality in the hydraulic system is reliably detected by using determination oil pressure level set close to a target oil pressure level as described above.

The present invention may be used in either of a diesel engine or a gasoline engine.

What is claimed is:

1. An abnormality detecting device for a hydraulic system having an oil pressure adjusting mechanism that adjusts oil pressure in accordance with an operating state of an internal combustion engine, the oil pressure being generated by an oil pump that is driven by the internal combustion engine, the device comprising:

an oil pressure detecting section that detects oil pressure adjusted by the oil pressure adjusting mechanism;

an oil pressure comparing section, wherein, when the oil pressure adjusting mechanism changes the oil pressure from a first oil pressure level to a second oil pressure level, which is higher than the first oil pressure level, the oil pressure comparing section compares, during a determination time, the oil pressure detected by the oil pressure detecting section with a determination oil pressure level, which is lower than and close to the second oil pressure level; and an abnormality determining section that determines that there is an abnormality in the hydraulic system if the oil pressure detected by the oil pressure detecting section does not change to pass the determination oil pressure level within the determination time, wherein the determination time is determined based on an operating state of the engine.

2. The detecting device according to claim 1, wherein the difference between the determination oil pressure level and the second oil pressure level is constant regardless of the engine speed.

3. The detecting device according to claim 1, wherein the oil pressure adjusting mechanism adjusts the oil pressure to one of a plurality of stages in accordance with the operating state of the internal combustion engine.

4. The detecting device according to claim 3, wherein the oil pressure adjusting mechanism adjusts the oil pressure to one of two stages in accordance with the operating state of the internal combustion engine.

5. The detecting device according to claim 1, wherein the oil pressure adjusting mechanism continuously adjusts the oil pressure in accordance with the operating state of the internal combustion engine.

6. An abnormality detecting device for a hydraulic system having an oil pressure adjusting mechanism that adjusts oil pressure in accordance with an operating state of an internal combustion engine, the oil pressure being generated by an oil pump that is driven by the internal combustion engine, the device comprising:

an oil pressure detecting section that detects oil pressure adjusted by the oil pressure adjusting mechanism;

an oil pressure comparing section, wherein, when the oil pressure adjusting mechanism changes the oil pressure from a first oil pressure level to a second oil pressure level, which is lower than the first oil pressure level, the oil pressure comparing section compares, during a determination time, the oil pressure detected by the oil pressure detecting section with a determination oil pressure level, which is higher than and close to the second oil pressure level; and an abnormality determining section that determines that there is an abnormality in the hydraulic system if the oil pressure detected by the oil pressure detecting section does not change to pass the determination oil pressure level within the determination time, wherein the determination time is determined based on an operating state of the engine.

7. The detecting device according to claim 6, wherein the difference between the determination oil pressure level and the second oil pressure level is constant regardless of the engine speed.

8. The detecting device according to claim 6, wherein the oil pressure adjusting mechanism adjusts the oil pressure to one of a plurality of stages in accordance with the operating state of the internal combustion engine.

9. The detecting device according to claim 8, wherein the oil pressure adjusting mechanism adjusts the oil pressure to one of two stages in accordance with the operating state of the internal combustion engine.

10. The detecting device according to claim 6, wherein the oil pressure adjusting mechanism continuously adjusts the oil pressure in accordance with the operating state of the internal combustion engine.

11. An abnormality detecting device for a hydraulic system having an oil pressure adjusting mechanism that adjusts oil pressure in accordance with an operating state of an internal combustion engine, the oil pressure being generated by an oil pump that is driven by the internal combustion engine, the device comprising:

an oil pressure detecting section that detects oil pressure adjusted by the oil pressure adjusting mechanism;

an oil pressure comparing section, wherein, when the oil pressure adjusting mechanism changes the oil pressure from a first oil pressure level to a second oil pressure level, which is set to be higher than the first oil pressure level, the oil pressure comparing section compares, during a determination time, the oil pressure detected by the oil pressure detecting section with a determination oil pressure level, which is set to be lower than and close to the second oil pressure level, and wherein, when the oil pressure adjusting mechanism changes the oil pressure from the first oil pressure level to the second oil pressure level, which is set to be lower than the first oil pressure level, the oil pressure comparing section compares, during the determination time, the oil pressure detected by the oil pressure detecting section with the determination oil pressure level, which is set to be higher than and close to the second oil pressure level;

an abnormality determining section that determines that there is an abnormality in the hydraulic system if the oil pressure detected by the oil pressure detecting section does not change to pass the determination oil pressure level within the determination time, wherein the determination time is determined based on an operating state of the engine.

12. The detecting device according to claim 1, further comprising an engine speed detecting section that detects a speed of the internal combustion engine, wherein the abnormality determining section does not execute abnormality determination when the engine speed detected by the engine speed detecting section is lower than a threshold engine speed, and wherein the threshold engine speed is a lowermost value of a region of the engine speed that is set to avoid erroneous determination and is also determined by an engine oil temperature.

13. The detecting device according to claim 12, wherein the threshold engine speed is greater than an upper limit of a range of the engine speed in which a tolerance of oil pressure adjustment to the first oil pressure level by the oil pressure adjusting mechanism and a tolerance of detection the oil pressure detected by the detecting section overlap.

14. The detecting device according to claim 6, further comprising an engine speed detecting section that detects a speed of the internal combustion engine, wherein the abnormality determining section does not execute abnormality determination when the engine speed detected by the engine speed detecting section is lower than a threshold engine speed, and wherein the threshold engine speed is a lowermost value of a region of the engine speed that is set to avoid erroneous determination and is also determined by an engine oil temperature.

15. The detecting device according to claim 14, wherein the threshold engine speed is greater than an upper limit of a range of the engine speed in which a tolerance of oil pressure adjustment to the first oil pressure level by the oil pressure adjusting mechanism and a tolerance of detection the oil pressure detected by the detecting section overlap.

16. The detecting device according to claim 11, further comprising an engine speed detecting section that detects a speed of the internal combustion engine, wherein the abnormality determining section does not execute abnormality determination when the engine speed detected by the engine speed detecting section is lower than a threshold engine speed, and wherein the threshold engine speed is a lowermost value of a region of the engine speed that is set to avoid erroneous determination and is also determined by an engine oil temperature.

* * * * *